United States Patent [19]

Baker et al.

[11] 4,312,104

[45] Jan. 26, 1982

[54] CONVERTIBLE INTERIOR UPHOLSTERY FOR A BURIAL CASKET

[75] Inventors: Juanita Baker, Metamora; Keith E. Miller, Batesville, both of Ind.

[73] Assignee: Batesville Casket Company, Inc., Batesville, Ind.

[21] Appl. No.: 149,933

[22] Filed: May 14, 1980

[51] Int. Cl.[3] ..... A61G 17/00
[52] U.S. Cl. ..... 27/19
[58] Field of Search ..... 27/19, 17, 6

[56] References Cited

U.S. PATENT DOCUMENTS

| | | | |
|---|---|---|---|
| 2,044,967 | 6/1936 | Bowler, Jr. | 27/19 |
| 3,233,302 | 2/1966 | Ross | 27/6 |
| 3,246,379 | 4/1966 | Slaughter et al. | 27/19 |
| 4,003,109 | 1/1977 | Matichak | 27/19 |

OTHER PUBLICATIONS

Reversible Pillows & Reversible Overlays, Sumter Casket Co. since 1969.

*Primary Examiner*—John D. Yasko
*Attorney, Agent, or Firm*—Burns, Doane, Swecker & Mathis

[57] ABSTRACT

A big body for use in overlying the container rim of a casket comprises a plurality of separate panels mountable to the container. When the casket is open for viewing, one panel hangs within the container and presents an exposed side. Another panel overlies the rim of the container and presents an exposed side. A third panel is movable between a hanging position within the container and an overlying position over the container rim such that either side thereof is exposed. The panels are mutually positionable in a first mode wherein the exposed sides of the hanging and overlying panels have a first ornamental appearance, and a second mode wherein the exposed sides of the hanging and overlying panels have a second, different ornamental appearance.

10 Claims, 5 Drawing Figures

CONVERTIBLE INTERIOR UPHOLSTERY FOR A BURIAL CASKET

BACKGROUND AND OBJECTS OF THE INVENTION

The present invention relates to burial caskets and, in particular, to decorative interior upholstery therefor.

Traditionally, burial caskets are provided with decorative interior upholstery which includes a pillow case and a so-called "big body" or shrine which overlies the casket rim. In cases where a half-lid type of casket is employed, an overthrow is provided which overlies the foot portion of the lid when the head portion is open.

Upholstery of different color and ornamental appearance is generally available and is selected by the family of the deceased when the burial casket is purchased. In order to facilitate such selection, it is desirable that different interiors be demonstrated in the purchased casket. In that regard, pillows and overthrows are easily removed and replaced for such purpose. However, the usual techniques for installing big bodies in caskets render it difficult to readily interchange big bodies during demonstration. Attempts to avoid this problem have included the use of quick release fastenings for the big bodies (e.g., see Slaughter et al U.S. Pat. No. 3,246,379, Ross U.S. Pat. No. 3,233,302, Matichak U.S. Pat. No. 4,003,109 and Bowler U.S. Pat. No. 2,044,967). However, the arrangements thus-proposed involve manipulations whose performance is somewhat awkward during a demonstration.

It is, therefore, an object of the present invention to minimize and obviate drawbacks of the type discussed above.

Another object of the invention is to enable the demonstration of different casket interiors to be facilitated.

It is another object of the invention to provide a casket big body arrangement which enables different big bodies to be quickly and conveniently demonstrated in a casket.

A further object of the invention is to provide a reversible big body arrangment which enables different big bodies to be demonstrated in a given casket, without the need for removing and installing different big bodies.

SUMMARY OF THE INVENTION

These objects are achieved by the present invention which relates to a big body for use in overlying the container rim of a casket. The big body comprises a plurality of separate panels mountable to the container such that when the casket is open, a panel hangs within the container and presents an exposed side, a panel overlies the rim of the container and presents an exposed side, and a panel is movable between a hanging position within the container and an overlying position over the container rim such that either side thereof is exposed. The panels are mutually positionable in a first mode wherein the exposed sides of the hanging and overlying panels have a first ornamental appearance, and a second mode wherein the exposed sides of the hanging and overlying panels have a second, different ornamental appearance.

BRIEF DESCRIPTION OF THE DRAWINGS

These objects and advantages of the invention will become apparent from the following detailed description of a preferred embodiment thereof in connection with the accompanying drawings in which like numerals designate like elements, and in which.

BRIEF DESCRIPTION OF THE PREFERRED EMBODIMENT OF THE INVENTION

Figure 1:
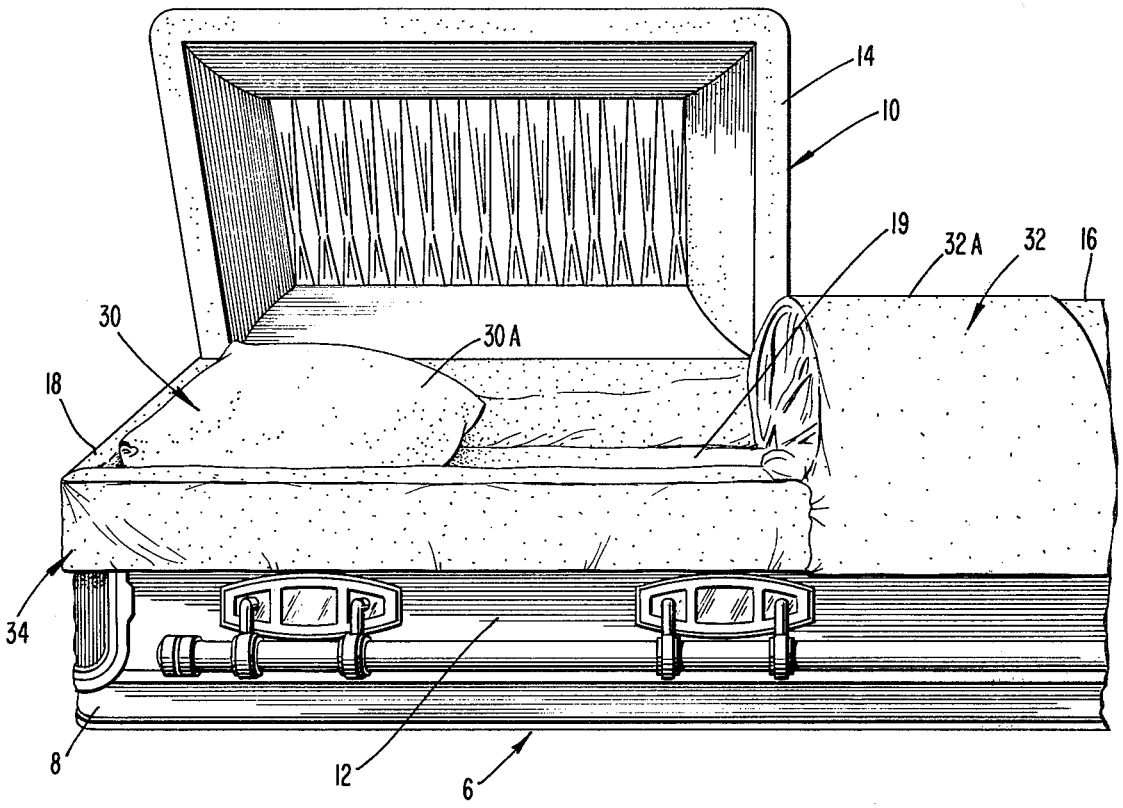
FIG. 1 is a side elevational view of a casket with a tailored interior upholstery exposed for viewing.

In FIG. 1 of the drawings there is depicted a burial casket 6 comprising a container 8 and a lid 10 formed of suitable material such as sheet metal for example. The depicted casket is of the split-lid variety, wherein the lid 10 comprises head and foot portions 14 and 16. These lid portions 14, 16 are pivotably secured by conventional hinges to the container 8.

The container 8 comprises opposed side walls including a front side wall 12, and opposed end walls including a head end wall 18. The front side wall 12 includes an upright portion 14 and a horizontal ledge portion 16 on which may be mounted a conventional rubber gasket 18. Integral with the ledge 16 is a channel 20 formed by bent sections of the sheet metal. A mattress 19 is supported within the container in conventional fashion.

The casket includes decorative interior upholstery including a pillow case 30, an overthrow 32 overlying a not-shown conventional gasket (if provided) between the lid portions 14, 16 when the container is open for viewing purposes, and a big body 34 overlying the rim of the front side wall 12 and the head end wall 18. Purchasors of the casket may select from interiors of different appearances, including a tailored appearance (FIG. 1), or a shirred appearance (FIG. 2), for example.

To that end, the pillow case 30 is preferably reversible, i.e., it includes a tailored side 30A (FIG. 1) and a shirred side 30B (FIG. 2) so that different appearances can be presented by turning-over the pillow. The overthrow is preferably similarly reversible, having a tailored side 32A (FIG. 1) and a shirred side 32B (FIG. 2) so that turning-over of the overthrow changes its appearance.

The big body 34 comprises an assembly of upholstery panels which include tailored and shirred sides, it being necessary to merely flip a panel to achieve a different appearance for the big body. In this regard, the big body comprises a first or inner panel 36 (FIGS. 3–4) containing a shirred side 37 facing the interior of the container. Adjacent the first panel is a second or intermediate panel 38 which includes a shirred side 40 and an opposite tailored side 42. When the second panel 38 hangs within the container (FIG. 3), the shirred side 40 thereof faces the shirred side of the first panel (is hidden from view) and the tailored side 42 is exposed and faces the interior of the container.

Figure 3:
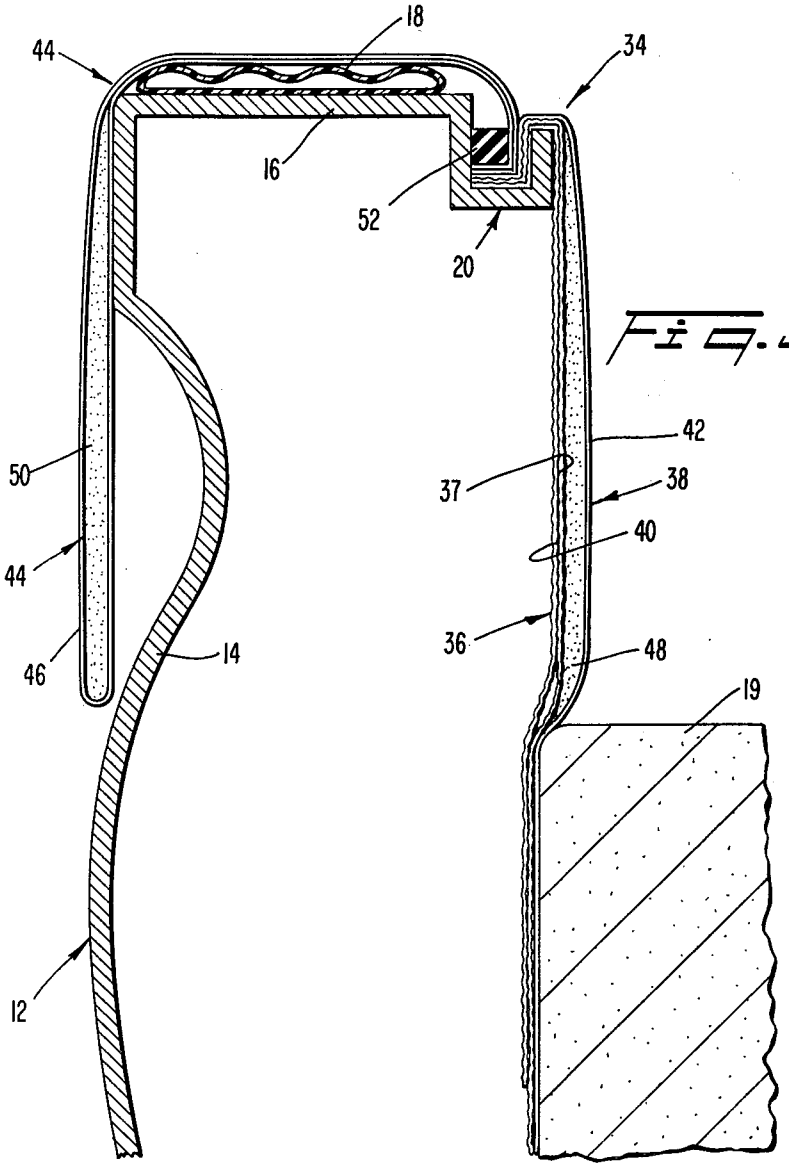
FIG. 3 is a cross-sectional view through a side rim of the casket of FIG. 1.

Adjacent the second panel is a third or outer panel 44 which is adapted to overlie the shoulder 16 and the upper end of the upright portion 14 of the side wall 12 of the container (FIG. 3). In such orientation, an exposed side 46 of the third panel presents a tailored appearance.

The second panel 38 can be flipped-over so as to hang outside the container and overlie the third panel 44, whereupon the shirred side 40 of the second panel is exposed while hiding the tailored side 46 of the third panel.

Preferably, the second and third panels 38, 44 each carry an internal foam padding 48, 50 to achieve a more plush effect.

It will be appreciated that, in accordance with the present invention, the third panel 44 can be arranged to overlie the walls 12, 18 with the second panel 38 arranged to hang within the container (FIG. 3) so as to present a tailored appearance internally and externally by the exposed tailored sides 42, 46 of those panels (FIGS. 1, 3).

Figure 2:
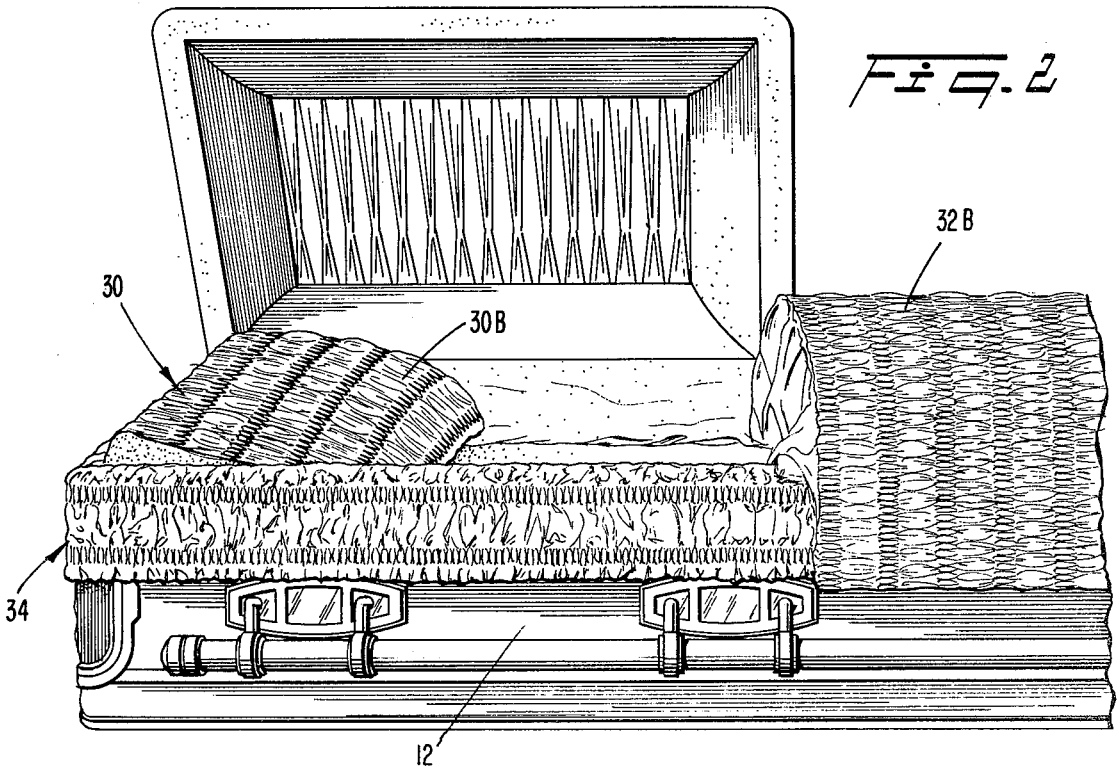
FIG. 2 is a side elevational view of the casket with a shirred interior upholstery exposed for viewing.
Figure 4:
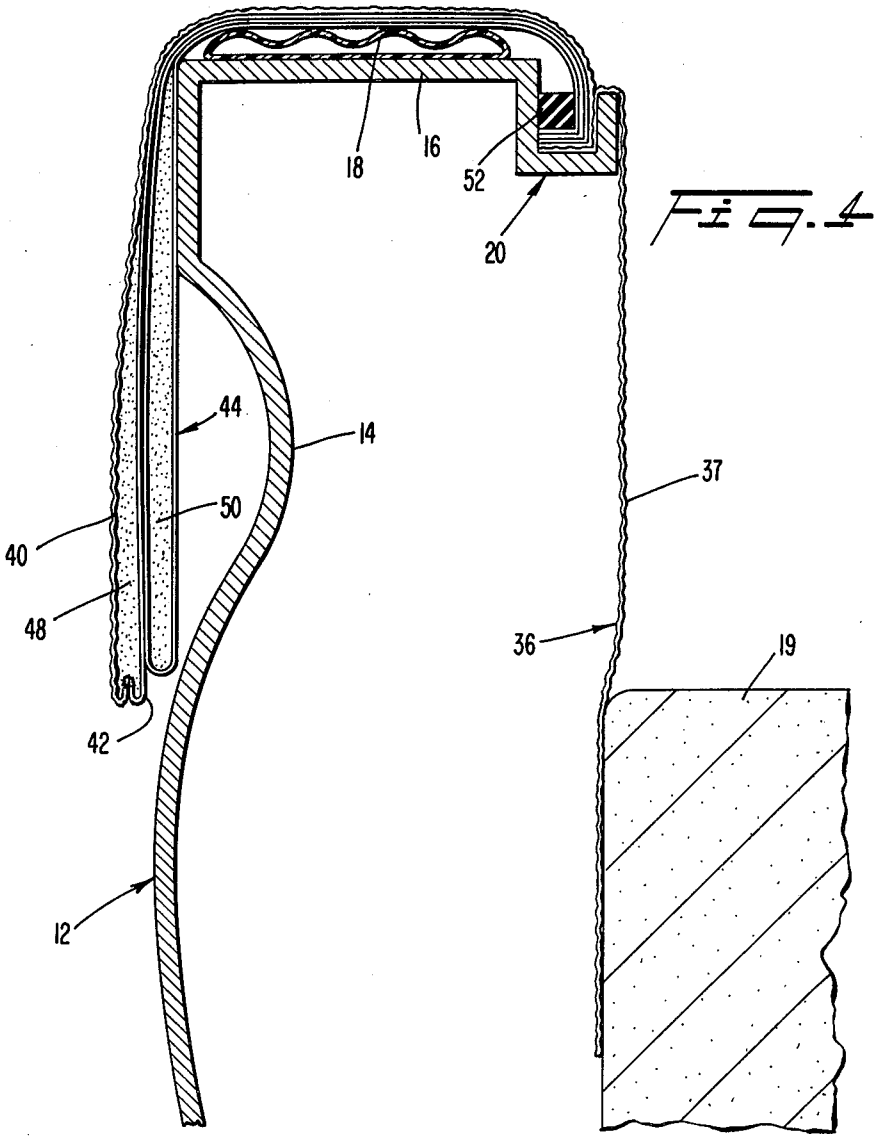
FIG. 4 is a cross-sectional view through a side rim of the casket of FIG. 2.

If it is desired to convert to a shirred appearance for the walls 12, 18, it is merely necessary to flip the second panel 38 over onto the third panel, whereby a shirred appearance is presented internally and externally by the exposed shirred sides 40, 37 of the second and first panels 38, 36 (FIGS. 2, 4).

The first, second and third panels may be mounted on the side walls of the container in any suitable fashion. For example, the panels may be sewn together at their anchoring ends and secured within the channel 20 by means of a conventional gimp or wedge block 52 which is press-fit in the channel 20 in conventional fashion.

Figure 5:
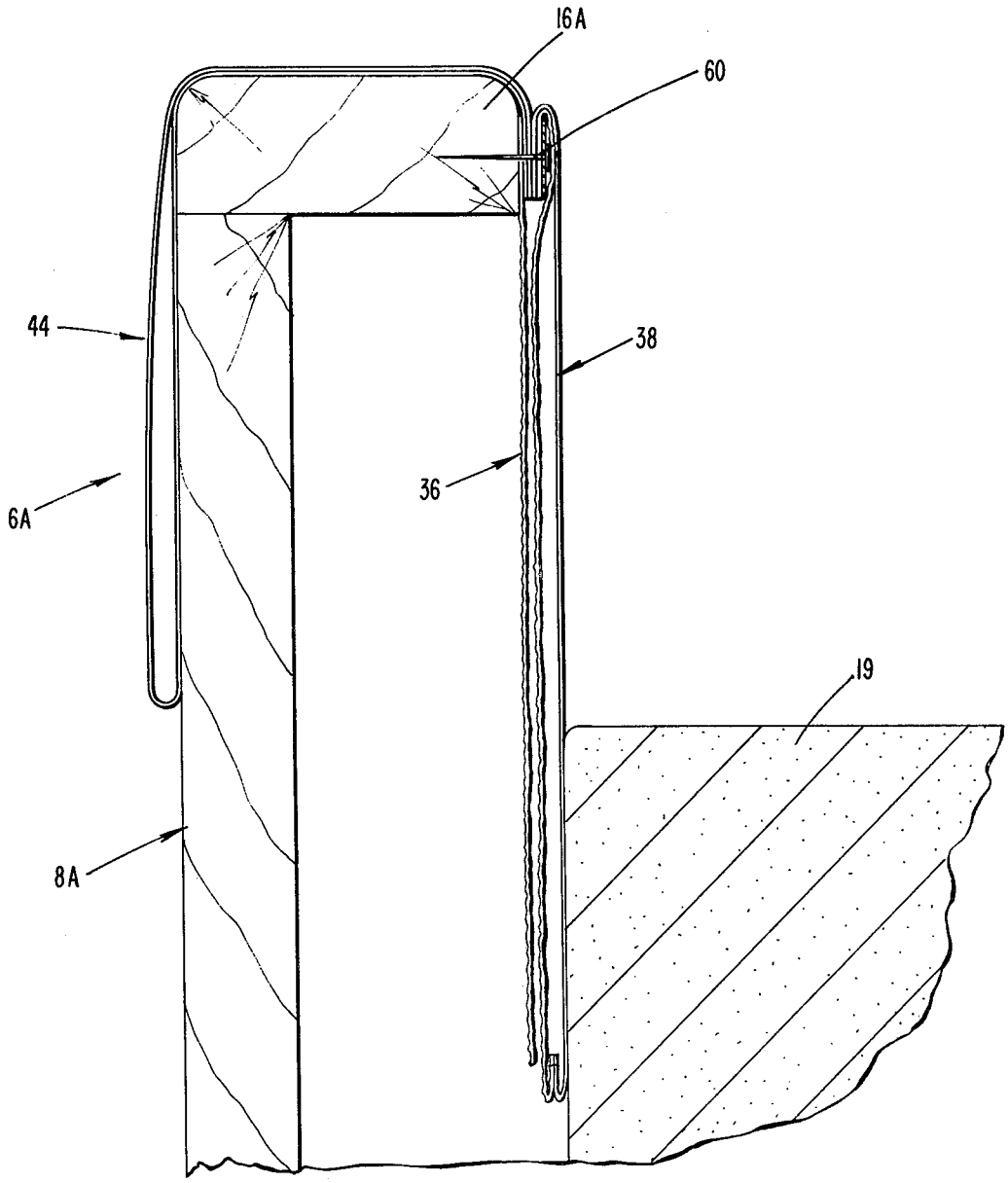
FIG. 5 is a cross-sectional view through a side rim of a casket showing another possible mounting technique.

Another possible mounting technique, employable especially in connection with a wooden casket 6A (FIG. 5), involves simply tacking the panels to a shoulder 16A of the container 8A by sharpened tacks 60. Of course, the same mounting as depicted earlier could be used in connection with a wooden casket.

It will be appreciated that a variety of visual effects can be achieved by different combinations of the big body 34; pillow case 30, and overthrow 32. For example, the big body may present a shirred appearance, while the pillow case and overthrow may each present a tailored effect, or vice versa. Changing of those visual effects during a demonstration to a bereaved family is simplified by the present invention, especially as regards the big body 34 which heretofore has represented the most awkward component to change.

It will be appreciated that the present invention is applicable to the full-lid type of caskets as well as the split-lid type. In a full-lid casket, the overthrow is eliminated and the big body overlies the end walls and front side wall.

It will be understood that more than one intermediate panel can be provided so as to enable more types of appearances to be exhibited.

In practice, a casket is demonstrated, and the deceased is viewed, with the upholstery in the desired condition. Before the casket is interred, the big body is simply folded into the interior of the container in the customary manner.

In accordance with the present invention, a casket can be demonstrated in a highly effective and convenient manner. By merely reversing the pillow (and/or the overthrow if a split-lid casket is employed), and by flipping the intermediate panel to its inside or outside hanging position, the overall ornamental appearance of the interior upholstery can be varied. There is no need to remove and substitute different big bodies and handling thereof is not awkward in nature.

Although the invention has been described in connection with a preferred embodiment thereof, it will be appreciated by those skilled in the art, that additions, modifications, substitutions, and deletions not specifically described may be made without departing from the spirit or scope of the invention as defined in the appended claims.

What is claimed is:

1. A big body for use in overlying the container rim of a casket, said big body comprising:

a plurality of separate panels mountable to the container such that an inner panel is disposed inside the container and presents an exposable side, an outer panel hangs outside the container and overlies the rim of the container and presents an exposable side, and a swinging panel is movable between an inside position in which it hangs inside the container to cover said exposable side of said inner panel and an outside position in which it hangs over the container rim to cover said exposable side of said outer panel and such that either side of said swing panel is exposed, said sides of said swinging panel having different ornamental appearances, said panels being mutually positionable in:

a first mode wherein the exposed sides of the inside and outside panels have a first ornamental appearance, and a second mode wherein the exposed sides of the inside and outside panels have a second, different ornamental appearance.

2. Apparatus according to claim 1, wherein said first ornamental appearance is shirred and said second ornamental appearance is tailored.

3. In a casket of the type having a container and a decorative interior upholstery therein and a big body overlying a rim of the container when the container is open, said big body comprising:

separate first, second, and third panels of fabric;

said first panel including a side having one type of ornamental appearance, said second panel including one side having said one type of ornamental appearance and another side having another type of ornamental appearance, said third panel including a side having said other type of ornamental appearance;

said panels being mountable on the container such that as said first panel hangs within the container with said side thereof facing the container interior and said third panel overlies the container rim with said side thereof exposed, said second panel is movable between:

a first position hanging within the container over said first panel with said other side of said second panel exposed and facing said interior of the container, such that the exposed sides of said second and third panels present said other ornamental appearance, and a second position hanging outside the container and overlying said third panel and said container rim such that said side of said first panel and said other side of said second panel are exposed to present said one ornamental appearance.

4. A big body according to claim 3, wherein the one type of ornamental appearance is shirred, and said other type of ornamental appearance is tailored.

5. A big body according to claim 3, wherein said first, second, and third panels are mountable within a channel of the container.

6. In combination, a casket of the type having a container and decorative interior upholstery within said container, said upholstery comprising a pillow case and a big body overlying a rim of the container when the container is open, said big body comprising:

a plurality of separate panels mounted to said container such that at least one panel is disposed inside said interior of said casket and presents an exposable side, at least one panel hangs outside the container and overlies said rim and presents an exposable side, and at least one panel is movable between inside and outside hanging positions such that either side is exposed, said panels being mutually positionable in:

a first mode wherein the exposed sides of said inside and outside panels have a first ornamental appearance, and a second mode wherein the exposed sides of said inside and outside panels have a second, different ornamental appearance, and said pillow case including a first side having said first ornamental appearance, and an opposite side having said second ornamental appearance, whereby said pillow case may be turned to create different visual effects with said big body.

7. Apparatus according to claim 6, wherein said container rim includes a channel, said panels mounted within said channel.

8. Apparatus according to claim 6, wherein said casket is of the full-lid type.

9. Apparatus according to claim 6, wherein said casket is of the split-lid type including a head section and a foot section, an overthrow provided for overlying said foot section when the head section is open, said overthrow including one side having said first ornamental appearance, and second side having said second ornamental appearance, said overthrow being selectively reversible.

10. A big body for use with a casket, comprising a pair of upholstery panels mountable to the casket for independent swinging displacement between a hanging position within the casket and an outer hanging position overlying a rim of the casket, wherein a side of each swingable panel faces outwardly when the panel is in said outer position, and wherein one of said hanging panels covers the other panel when both panels are hanging in said outer position, said outward sides of said panels presenting different decorative appearances such that the appearance of said big body is different when both of said panels are hanging in said outer position than when only said other panel is hanging in said outer position.

* * * * *